United States Patent [19]

Sarnosky et al.

[11] Patent Number: 4,510,851

[45] Date of Patent: Apr. 16, 1985

[54] VENTILATION FAN

[75] Inventors: Joseph R. Sarnosky, Fort Atkinson; David W. Wolbrink, Hartford; Dieter W. Otte, Rubicon, all of Wis.

[73] Assignee: Broan Mfg. Co., Inc., Hartford, Wis.

[21] Appl. No.: 584,307

[22] Filed: Mar. 5, 1984

Related U.S. Application Data

[63] Continuation of Ser. No. 324,459, Nov. 24, 1981, abandoned.

[51] Int. Cl.[3] ..... F24F 7/06

[52] U.S. Cl. ..... 98/42.08; 98/116; 98/42.10

[58] Field of Search ..... 52/27, 39; 98/33 R, 98/39, 43 R, 116; 248/343, 342

[56] References Cited

U.S. PATENT DOCUMENTS

| | | | |
|---|---|---|---|
| 1,532,635 | 4/1925 | Osbun | 98/116 |
| 2,278,581 | 4/1942 | Dexter | 98/43 |
| 2,483,377 | 9/1949 | Young | 98/43 |
| 2,668,491 | 2/1954 | Gerlitz | 98/43 |
| 2,673,514 | 3/1954 | Hanks | 98/116 |
| 2,875,678 | 3/1959 | Shepherd | 98/43 R |
| 2,911,900 | 11/1959 | Rudy | 98/116 |
| 2,963,956 | 12/1960 | Hill | 98/116 |
| 2,987,258 | 6/1961 | North | 237/53 |
| 3,002,676 | 10/1961 | Papsdorf . | |
| 3,045,579 | 7/1962 | Jenh et al. | 98/43 |
| 3,064,548 | 11/1962 | Field | 98/43 |
| 3,101,662 | 8/1963 | Alldritt | 98/43 |
| 3,211,080 | 10/1965 | Rader | 98/43 R X |
| 3,212,425 | 10/1965 | Hazen et al. | 98/43 |
| 3,665,838 | 5/1972 | Sherpherd | 98/40 DL |
| 3,788,207 | 1/1974 | Doherty | 98/43 X |
| 3,952,638 | 4/1976 | Felter et al. | 98/43 R |
| 4,335,647 | 6/1982 | Timmons | 98/40 D |
| 4,336,749 | 6/1982 | Barhart et al. | 98/43 R |
| 4,385,550 | 5/1983 | Steiner et al. | 98/43 R |
| 4,406,216 | 9/1983 | Hott et al. | 98/116 |

FOREIGN PATENT DOCUMENTS

| | | | |
|---|---|---|---|
| 648597 | 9/1964 | Belgium | 98/43 R |

*Primary Examiner*—Harold Joyce

*Attorney, Agent, or Firm*—Andrus, Sceales, Starke & Sawall

[57] ABSTRACT

A ventilation fan structure has a fan blade-motor portion and a shroud portion independently affixable to the ceiling to reduce noise levels, improve aerodynamic efficiency, and facilitate installation. Mounting members are affixable to ceiling joists spanning the opening for the fan structure. The drive motor and associated fan blades are mounted on the mounting members. The shroud surrounds the ceiling opening and embraces the fan blades.

7 Claims, 7 Drawing Figures

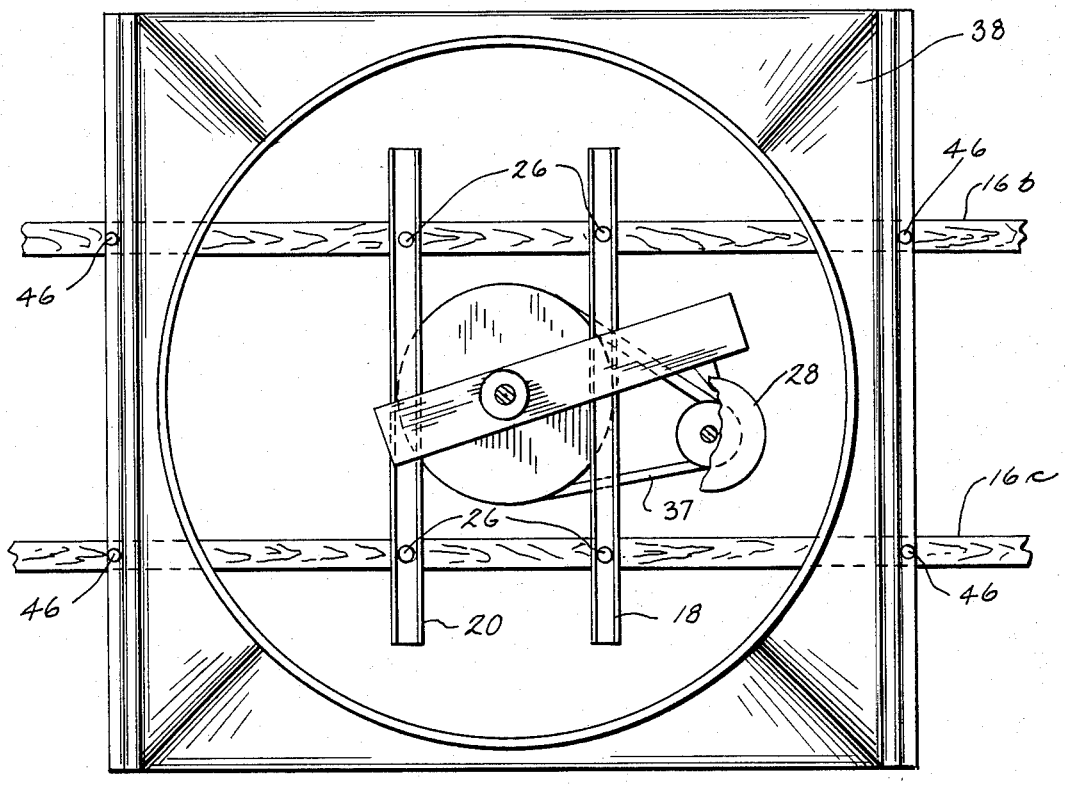
Fig 6
Fig. 7
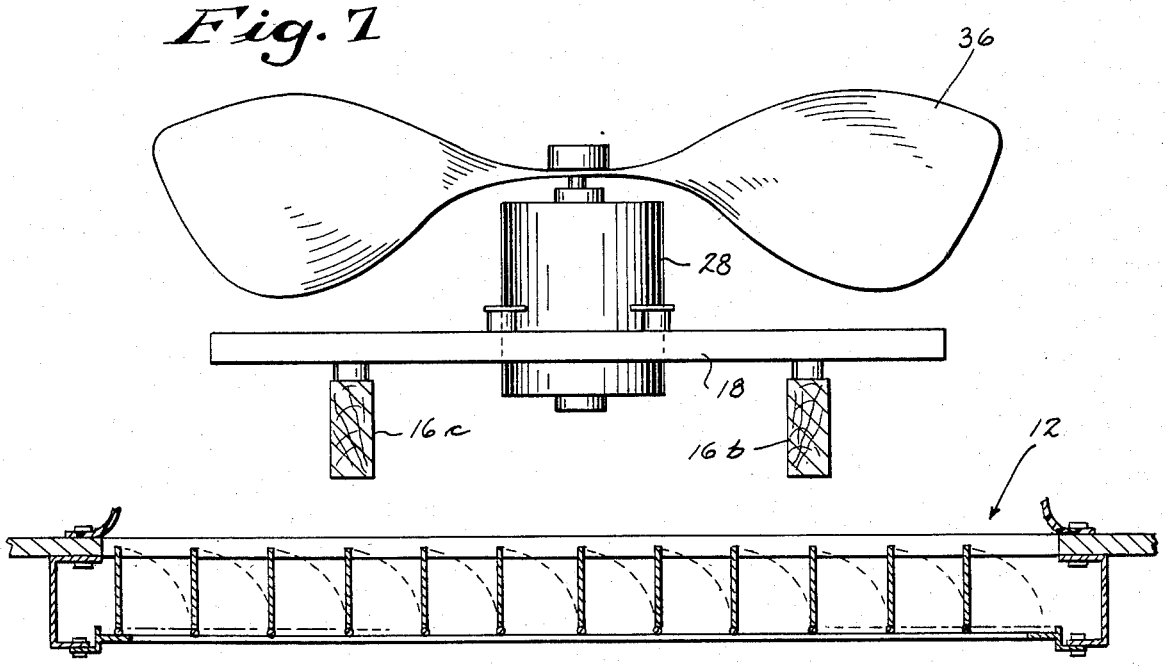

VENTILATION FAN

The present application is a continuation application of U.S. patent application Ser. No. 324,459, filed Nov. 24, 1981 and now abandoned.

Ventilation fans of the so-called "whole house" type are mounted in the ceiling of a house immediately below the attic. The fan draws up air from the basement or lower portions of the house, passes it through an opening in the ceiling, and discharges it out a vent in the gable or roof. Ventilation and cooling are thus provided to the house.

Typical fans currently in use include a box that surrounds the hole in the ceiling and is fastened to the ceiling joists. A sheet metal shroud extends across the box. Arched metal frames on the shroud or box support the fan blades adjacent the shroud. The fan may be directly coupled to the driving motor or, the motor may be mounted in an off-set position on the frame, shroud, or box and connected to the fan by a belt.

A number of problems exist in such fans. One such problem is undesirable noise levels. These usually arise from the somewhat cantilevered mounting of the fan blades and motor on the arched frames that transmits and enhances vibrations of the fan and motor, the tendency of the sheet metal shroud to resonate such vibration, and the difficulty in effectively applying vibration absorbing material to the fan. The aerodynamic efficiency of the fan is lessened because of the configurational limitations on the shroud, particularly its axial depth, imposed by the frames and because of structural compromises needed to obtain physical strength, vibration resistance, and other necessary or desired properties.

Installation of the fan is difficult and usually requires severing one or more ceiling joists in order to install the box. In many cases, the ceiling joist is also a stringer of a roof truss. Such a member is tensioned when the roof truss is loaded and severance may cause displacement of the rafters.

It is, therefore, the object of the present invention to provide an improved ventilation fan that, among other features, exhibits low operational noise levels, has high aerodynamic efficiency, and is easy to install.

These advantages are obtained in the fan structure of the present invention by mounting the fan blade-motor portion of the fan and the shroud portion of the fan independently of each other on the ceiling of the house. Such independent mounting reduces noise, particularly with respect to that generated in the shroud, since vibration transmission is blocked by the independent mounting. The independent mounting facilitates the placement of sound and vibration absorbing elements in the fan. It permits the shroud to be formed specifically for improved aerodynamic efficiency of the fan. Independent mounting of fan blade-motor portion and the shroud portion simplifies the installation of the ventilation fan and avoids the need to sever joists or stringers in the ceiling.

The fan structure of the present invention includes mounting members affixable to the ceiling in its opening as by fastening to joists extending across the opening. Vibration and sound absorbing pads may be interposed between the mounting members and the joists. The drive motor for the fan blades is attached to the mounting members. Additional vibration absorbing means may be interposed between the motor and the mounting members.

A shroud is affixed to the ceiling or joists to surround the opening and embrace the fan blades. The shroud has a first portion mateable with the periphery of the ceiling opening and a second portion providing a tubular shroud adjacent the fan blades formed to enhance the aerodynamic efficiency of the fan.

The invention is further described with the aid of the drawing in which:

FIG. 6 is a plan view showing belt driven fan blades in the present invention; and FIG. 7 is a partial side view showing the use of louvers in connection with the fan structure.

Figure 1:
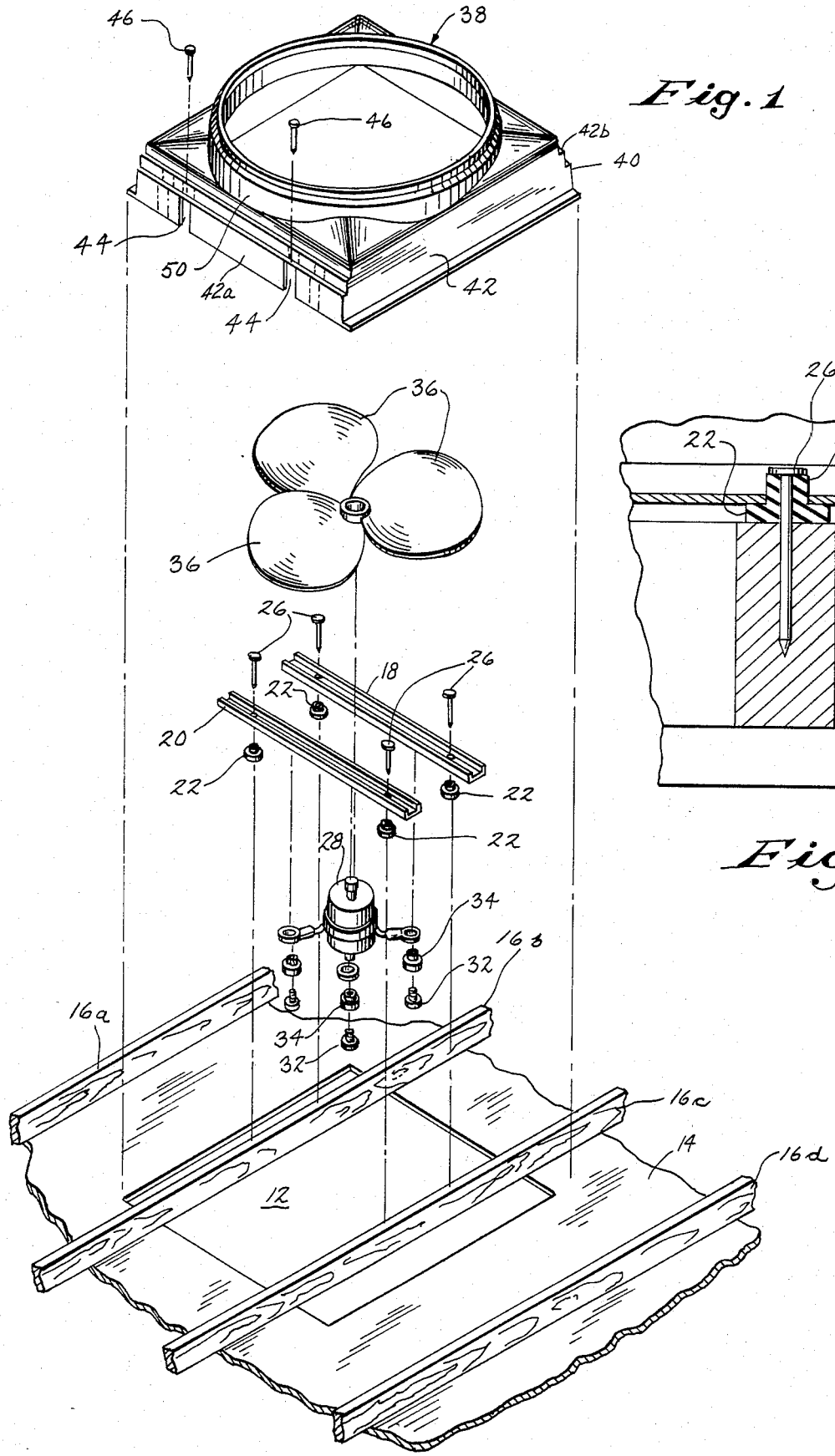
FIG. 1 is an exploded perspective view of the improved ventilation fan structure of the present invention.

In the drawing, the improved ventilation fan structure of the present invention is indicated by the numeral 10. Fan 10 may be employed to exhaust air through opening 12 previously cut in ceiling 14 for this purpose. Ceiling 14 is supported by joists or stringers 16*a*, 16*b*, 16*c*, and 16*d*. While in the past, it has been necessary to cut away the portions of stringers 16*b* and 16*c* extending across opening 12, the stringers are left intact with the ventilation fan structure of the present invention. Possible weakening of roof trusses is thus avoided.

Figure 5:
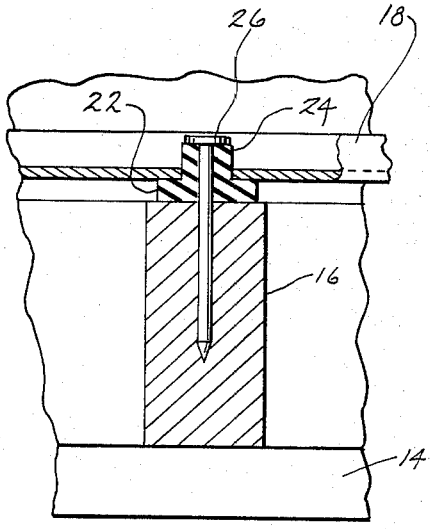
FIG. 5 is a detailed partial cross-sectional view of a portion of the structure shown in FIG. 3.

A mounting member means, comprised of a pair of laterally spaced mounting members. is positioned across joists 16*b* and 16*c*. As shown most clearly in FIG. 5, mounting members 18 and 20 may be positioned on joists 16*b* and 16*c* by means of resilient discs 22 having resilient pins 24 extending through holes in the mounting members. Discs 22 are secured to the joists by nails 26 and the mounting members retained on the discs and pins by their own weight and that of the apparatus associated therewith.

A drive means for fan 10, such as motor 28, has arms 30 fastened to mounting members 18 and 20 by a resilient mounting utilizing nuts and bolts 32 and resilient washers 34. It is anticipated that motor 28 and mounting members 18 and 20 will be factory assembled and supplied to the installer as a unit for installation on joists 16*b* and 16*c*. After this unit is installed, fan blades 36 are secured to the output shaft of motor 28 in the direct drive embodiment shown in FIG. 1. Or, fan blades 36 may be connected to a separately mounted motor 28 by drive belt 37, as shown in FIG. 6.

Figure 2:
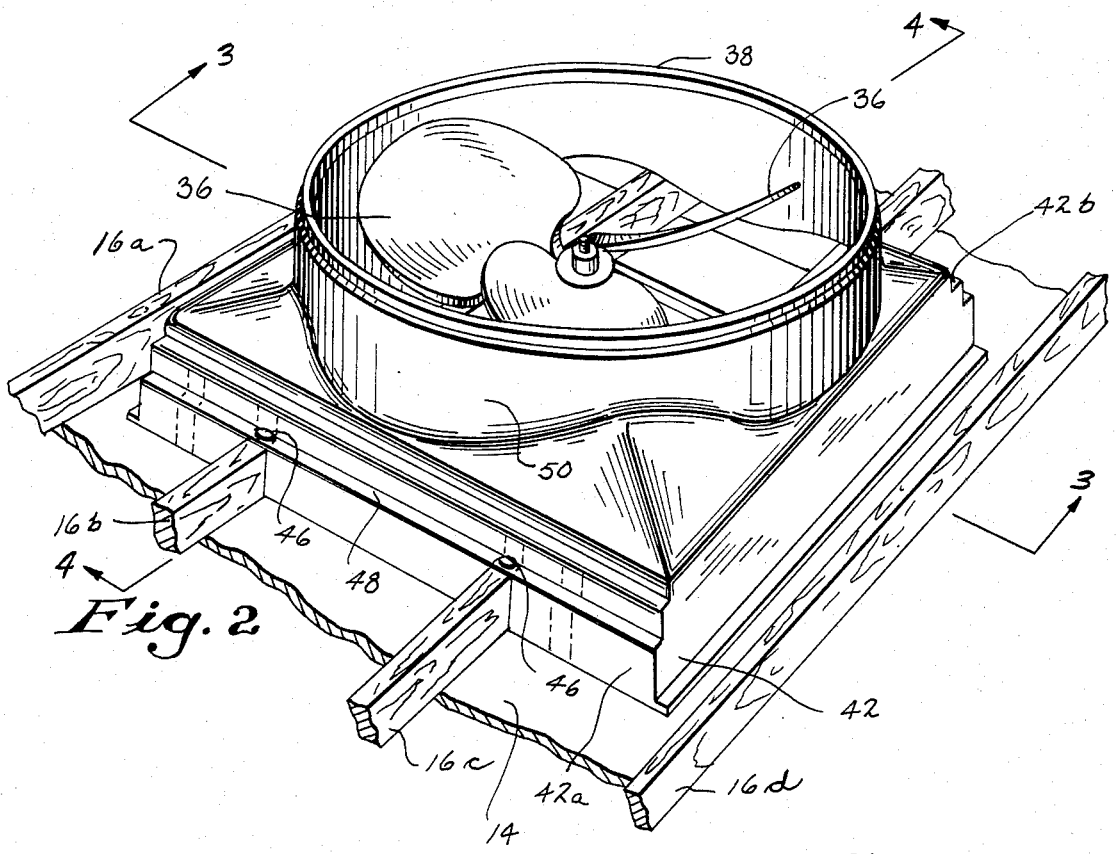
FIG. 2 is an assembled perspective view of the ventilation fan structure.
Figure 3:
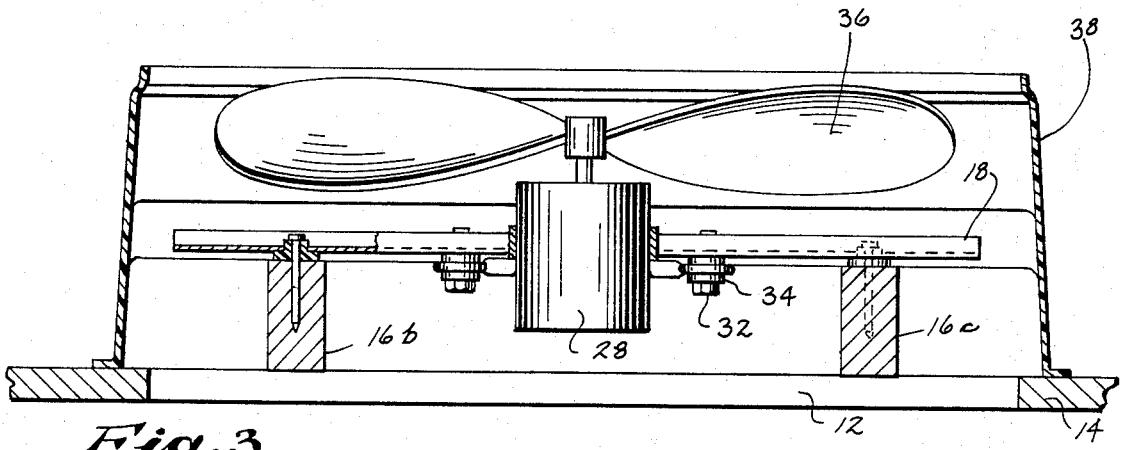
FIG. 3 is a cross-sectional view taken along the line 3—3 of FIG. 2.
Figure 4:
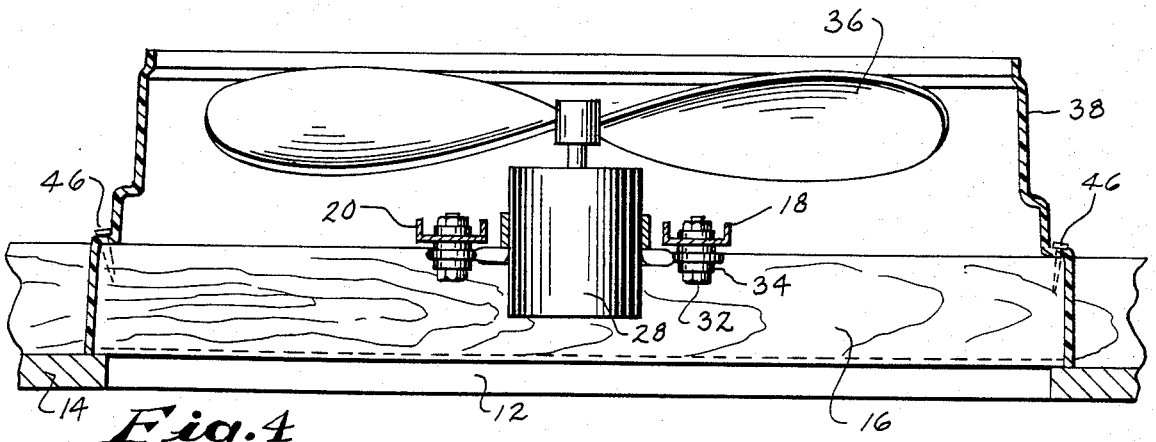
FIG. 4 is an additional cross-sectional view taken along the line 4—4 of FIG. 2.

Shroud 38 surrounds mounting members 18 and 20, motor 28, and fan blades 36. In accordance with the present invention, shroud 38 is fastened to joists 16*b* and 16*c* independently of mounting members 18 and 20. Shroud 38 has a lower rectangular portion 40, the walls 42 of which serve to seal opening 12. Two such walls 42*a* and 42*b*, contain knock-out slots 44 that permits shroud 38 to fit over joists 16*b* and 16*c* to faciliate this sealing. Walls 42*a* and 42*b* have a stepped configuration, shown most clearly in FIGS. 2 and 4 that faciliates cutting the slots to the correct depth to match various height joists, such as 4" and 6" joists. A plurality of knock out slots 44 are provided in walls 42*a* and 42*b* to accommodate different spacing of the joists. Shroud 38 is secured to joists 16*b* and 16*c* by nails 46 driven through flanges 48 in the steps on walls 42*a* and 42*b*.

The upper portion of the shroud 38 is a generally tubular configured portion 50 that embraces fan blades 36. Inasmuch as shroud 38 is affixed independently of mounting means 18 and 20 and is thus freed from constraints and compromises found in conventional designs, shroud 38 may assume the shape necessary to enhance the aerodynamic efficiency of fan blades 36. Shroud 38 may have a venturi like configuration and closely embrace the tips of fan blades 36 to avoid tip recirculating air currents. The transition portion between rectangular portion 40 and tubular portion 50 may provide the desired inlet curve and conditions for fan blades 36. Shroud 38 may be formed of light weight, non-load bearing, material, such as ABS plastic or glass reinforced plastic.

If desired, louvers may be placed across opening 12, as shown in FIG. 7, to close opening 12 when ventilation fan structure 10 is not in use.

Various modes of carrying out the invention are contemplated as being within the scope of the following claims particularly pointing out and distinctly claiming the subject matter which is regarded as the invention.

We claim:

1. A ventilation fan structure positionable across an opening in a building member, said opening having parallel structural elements extending thereacross, said fan structure comprising:

mounting member means mountable on said structural elements in the opening therein;

rotary drive means fastened to said mounting member means;

rotatable axial flow fan blade means drivingly coupled to said rotary drive means and positionable in alignment with the building member opening for moving air through the opening; and shroud means separate and unconnected from said mounting member means, drive means, and fan blade means, said shroud means being affixable to the building member independently of said mounting member means, drive means, and fan blade means, said shroud means being formed to surround the building member opening and said mounting member means, drive means, and fan blade means said shroud means having a first portion mateable with the periphery of the building member opening and a second portion formed to embrace said fan blade means, said second portion of said shroud providing a generally tubular venturi-like element adjacent the plane of rotation of said fan blade means formed to enhance the aerodynamic efficiency of the fan blade means.

2. The fan device according to claim 1 wherein said mounting member means comprises a pair of spaced mounting members, said drive means is fastened between said mounting members, and said fan blade means is positioned above said mounting members.

3. The fan structure according to claim 1 wherein said shroud means has a curved inlet portion intermediate said first and second portions for further enhancing the aerodynamic efficiency of the fan blade means.

4. The fan structure according to claim 1 including vibration absorbing means interposable intermediate said mounting member means and the structural elements.

5. The fan structure according to claim 1 wherein said fan blade means is directly coupled to said rotary drive means.

6. The fan structure according to claim 1 wherein said fan blade means is coupled to said rotary drive means through power transmission means.

7. The fan structure according to claim 1 including louver means operatively associated with the building member opening.

* * * * *